United States Patent [19]

Quemore, Sr.

[11] 3,964,362

[45] June 22, 1976

[54] VIOLIN CONSTRUCTION

[76] Inventor: William J. Quemore, Sr., 149 E. Church St., Blackwood, N.J. 08012

[22] Filed: Jan. 3, 1975

[21] Appl. No.: 538,362

[52] U.S. Cl. ..... 84/173; 84/275

[51] Int. Cl.[2] ..... G10D 1/02

[58] Field of Search ..... 84/173, 267, 274–277, 84/280–281, 290–291, 302, 309–311

[56] References Cited

UNITED STATES PATENTS

| | | | |
|---|---|---|---|
| 129,653 | 7/1872 | Collins | 84/275 |
| 223,916 | 1/1880 | Howells | 84/309 |
| 252,744 | 1/1882 | Dennys | 84/274 |
| 895,593 | 8/1908 | Stone | 84/295 |
| 1,611,563 | 12/1926 | Rothman | 84/267 |
| 2,043,121 | 6/1936 | Quemore | 84/173 X |
| 3,822,628 | 7/1974 | Quemore | 84/275 |
| 3,853,032 | 12/1974 | Freeman | 84/275 |

*Primary Examiner*—Lawrence R. Franklin
*Attorney, Agent, or Firm*—Morton C. Jacobs

[57] ABSTRACT

A violin has a body in the form of a tube, is constructed of inexpensive materials, such as paperboard, and with low cost and mass production manufacturing techniques. A hook on the top surface at the end of said tube can be attached to a band around the violinist's body for playing the instrument without supporting it under the chin.

9 Claims, 6 Drawing Figures

VIOLIN CONSTRUCTION

BACKGROUND OF THE INVENTION

This invention relates to musical instruments of the class of violins.

The classical construction of violin, which is some hundreds of years old, and famous for beauty of its tone and design, has a complex shape, is the product of fine materials, long hours of painstaking effort by skilled craftsmen, and extended periods of aging and adjustment, all of which results in a costly instrument. Such a violin requires careful handling and must be protected against temperature extremes and high humidity.

The classical violin also makes heavy demands on the player. The violin must be retained under the chin and so held that the left hand is sufficiently free to move back and forth along the neck of the instrument with corresponding placement of the fingers along the fingering board. This holding of the violin between the chin and shoulder is not only fatiguing, but may be so painful that it is impossible for the elderly and extremely discouraging to the young. The fingering at the highest notes is extremely difficult to reach, and effectively impossible for many of the young and old, due to the width of the forward edge of the sounding box at the neck. One solution to this problem is described in applicant's patent U.S. Pat. No. 3,822,628. Other attempts to solve these problems (e.g., U.S. Pat. Nos. 3,136,197 and 1,303,466) without substantial changes in the design of the violin have not been successful.

The classical violin receives bridge stresses on the upper sounding box surface and has the central symmetrical cutaway parts to enable bowing, which results in a weakening of the sounding box in the vicinity of the bridge where the tensioned strings are supported.

SUMMARY OF THE INVENTION

Accordingly, it is among the objects of this invention to provide a new and improved violin.

Another object is to provide a new and improved violin which need not be held under the chin during playing.

Another object is to provide a new and improved violin which is easier to finger and bow.

Another object is to provide a new and improved violin constructed for the anatomy of the user.

Another object is to provide a new and improved violin which is suitable for use comfortably by young and old.

Another object is to provide a new and improved violin which can be manufactured conveniently and at moderate cost from readily available materials.

Another object is to provide a new and improved violin construction which distributes bridge stresses to sturdy sections of the violin body.

Another object is to provide a new and improved violin construction whereby the violin is easier to manipulate and play, less expensive to manufacture, and more durable and resistant to rough handling and changes in temperature, wetness and humidity than is a classical violin.

In accordance with one embodiment of this invention the body of a violin is constructed of a hollow paperboard tube having open ends. In use, the back end is pressed against the player's shoulder. The violin body is fitted with a hook connector to which a flexible band is connected, which band is attached around the player's body. Thereby the violin may be held against the player's body, similar to the familiar fiddler's position, but firmly retained so that full control is enabled without holding the instrument between chin and shoulder. The cylindrical violin body is narrow and cut off on its right side (as viewed from the player's position) near the neck and fingering board whereby full and comfortable access to the fingering board for the highest notes is achieved. The diameter of the body cylinder is sufficiently small to permit all bowing without indentations in the cylinder walls. The neck and fingering board is the traditional size so that any violinist can play it with ease. A removable bridge passes through a round hole in the top cylindrical surface and seats against the interior surface of the cylindrical body, and is fixed in position during play by tension of the strings which pass across its upper edge.

BRIEF DESCRIPTION OF THE DRAWING

The foregoing and other objects of this invention, the various features thereof, as well as the invention itself, will be more readily understood from the following description, which read together with the accompanying drawing, in which.

In the drawing, corresponding parts are referenced throughout by similar numerals.

DESCRIPTION OF A PREFERRED EMBODIMENT

Figure 1:
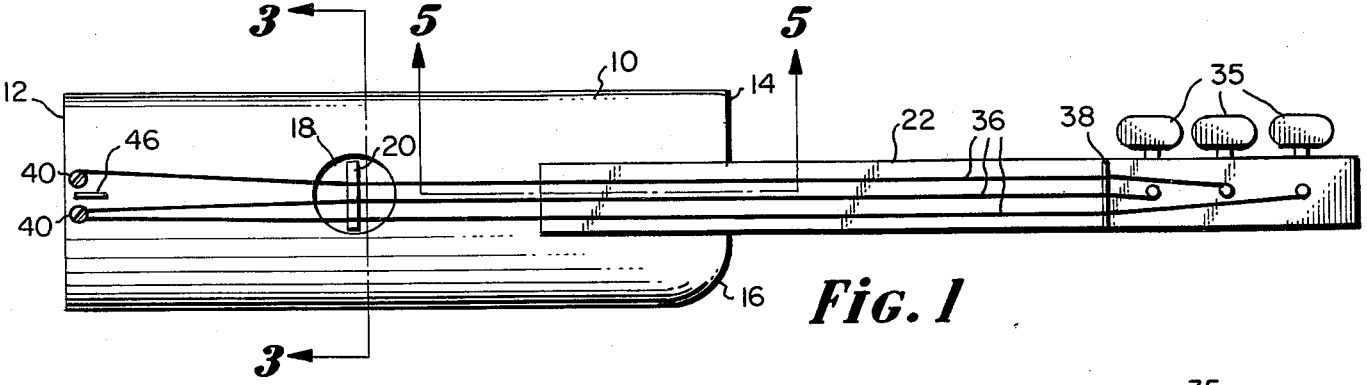
FIG. 1 is a plan view of a violin embodying this invention.
Figure 2:
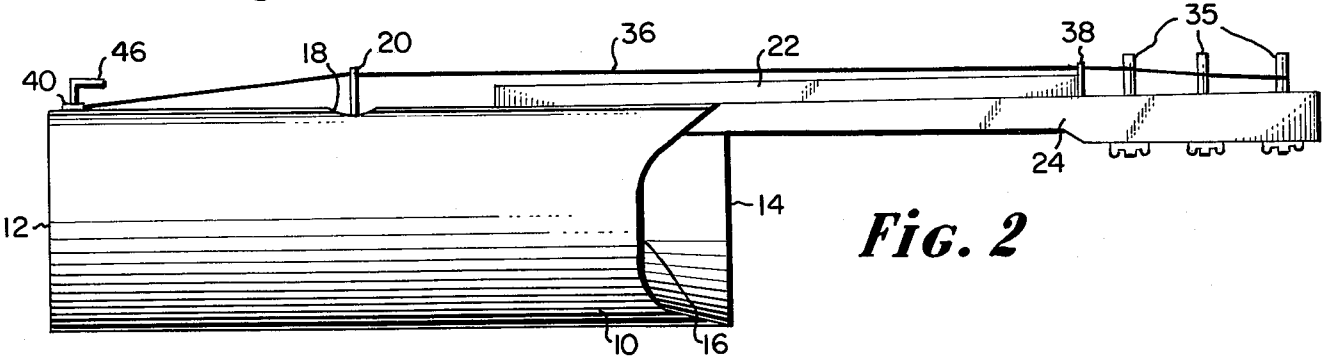
FIG. 2 is a side elevation view of the violin of FIG. 1.
Figure 3:
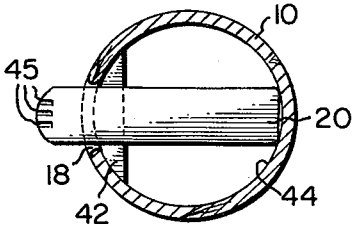
FIG. 3 is an end view of the violin of this invention taken at section 3—3 of FIG. 1.

With reference to FIGS. 1 through 5, the violin of this invention includes a hollow cylindrical tube 10, open at its ends, which comprises the body of said violin and serves functions equivalent to the sounding box conventional violins. The tube 10, in one form, is a right-angle cylinder and may be left open at both ends 12 and 14 along cuts in planes at right angles to the longitudinal axis of the tube. The end 14 of tube 10, adjacent the fingering hand, has its front surface cut out along right-hand edge 16 (as viewed by the player) to facilitate fingering on the violin during play of high notes, as a later discussion more fully explains. In a preferred embodiment, tubular body 10 is fabricated of rolled paperboard, an inexpensive material as compared to the expensive woods of a classical violin. The paperboard tube is painted (e.g., with a water-soluble paint) and waxed inside and out. These finish coatings provide a high degree of protection from water and humidity. Tube 10, in one practical form, is approximately 3.75 inches in diameter, by 0.125 inches thick and has a length approximating 11.75 inches; the invention, however, is not limited in its application to any particular set of dimensions. However, with a diameter of less than 5 inches, the curvature does not interfere with the bowing.

A circular hole 18 of relatively small diameter, e.g., one inch, is situated on the top of tubular body 10 near the point equidistant from its ends 12 and 14, but somewhat closer to the body-rested end 12. Hole 18 passes through the top surface of said cylindrical body 10 to provide a clearance hole for bridge 20. Said hole 18 also replaces and serves the function of the usual F-shaped sound holes in a conventional violin. A finger board 22 is attached to the top of tubular body 10, as explained below.

Finger board 22 (typically made of hardwood, such as ebony) is the same in all respects with finger boards used on conventional violins. Thereby, standard fingering is maintained consistent with the traditional fingering of the classical violin. Finger board 22 is attached to neck 24 (typically made of wood) by suitable fasteners 32, e.g., wood screws, and said assemblage of finger board 22 and neck 24 is in turn fastened by suitable fasteners 34, e.g., wood screws and gluing, to tubular body 10. When fastened to said tube 10, finger board 22 rests on the top surface of the tubular body, and neck 24 presses against corresponding inner surface of the tube (FIG. 5) with the assemblage of said finger board 22 and neck 24 forming an end slot 30 that embraces tube 10 therein and provides secure fastening.

In a preferred embodiment of this invention, machine-geared tuning keys 35, similar to those of the mandolin and guitar, are used to tighten the usual strings 36 that extend over the nut 38 to the bridge 20 and terminate at the back end 12 of tubular body 10. Three strings are used; a lesser or greater number of strings may be employed. (Three strings are believed to provide easier tuning, longer life and easier bowing than the conventional four-string arrangement.) The strings fasten to two fasteners 40 (e.g., round-headed screws) fixed to the top of tubular body 10 at back end 12. One fastener 40 provides attachment for two strings 36. In a preferred embodiment said fasteners 40 also engage a reinforcing segmental element 42 positioned inside (FIG. 3) and at end 12 of said tube 10.

Bridge 20 is a relatively thin rigid rectangular element, e.g., wood, which passes through hole 18 in tubular body 10 and rests on the interior surface 44 of said tubular body. Preferably, the two corners are the contact points of the bridge, which provide a three-point or tripod support of the bridge, where the third "point" of support is at the tensioned strings. Notches 45 in the top surface of bridge 20 provide guideways for strings 36 resting thereon in the manner of a conventional violin bridge. The tension in strings 36 (e.g., about 50 pounds) causes said strings to exert a downward force on bridge 20 which force positions bridge 20 firmly against the interior surface 44 of the tube 10. No glue or fasteners are required to prevent movement; the tripod support is extremely stable. Bridge 20 may be removed through the top when strings 36 are not present; or when strings are present bridge element 20 may be tilted and withdrawn through the front end 14 of tube 10.

In a preferred embodiment a hook 46 is attached to the top and at the center line of tubular body 10 near its bodysupported end 12; said hook attachment also engages reinforcing element 42. In an alternative embodiment hook 46 may be located somewhat to the right (as seen by the performing violinist) e.g., approximately one inch, of string mounting screws 40.

The cylindrical surface of the tubular body 10 enables the violinist to perform bowing at the bridge 20 and to engage strings 36 without interference from the other strings and without touching the sounding tube 10 itself with the bow. This cylindrical shape is inexpensive to achieve, and at the same time is extremely sturdy.

Figure 4:
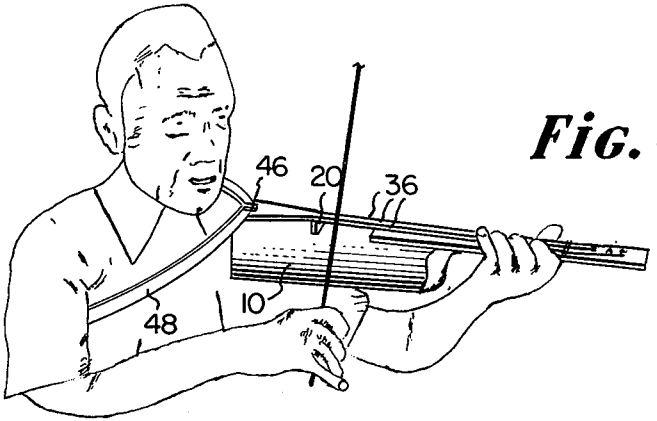
FIG. 4 illustrates the manner of holding the violin of FIG. 1 while being played.
Figure 5:
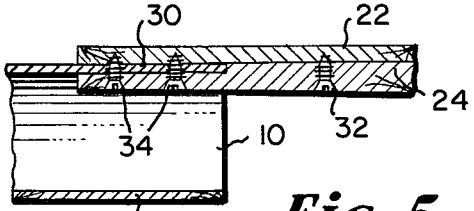
FIG. 5 is a view of this invention taken at section 5—5 of FIG. 1.

With the hook 46, the violin is attached to a strap 48 or other band which is connected around the body of the violinist, and preferably over the left shoulder and under the right arm. As illustrated in FIG. 4, the hook 46 engages under and against the strap 48. In this arrangement, the violin is firmly secured and rests against the left shoulder and chest of the violinist, preferably nested in the body recess at that location. The violin is pressed firmly against the shoulder and chest by the strap 48 and thereby held, so that conventional fingering in all seven poositions of the left hand of the violinist may be engaged in without the violin being under or engaged by the chin of the user. Thus, the violin is played with the sounding tube resting against the left shoulder and left chest of the user, and in a position completely relaxed and easily accessible to the bowing action of the right arm. The violin is securely held so that the fingering over the strings may be achieved with a firmly positioned and retained violin. No shoulder pads are needed, and no connection to the neck or chin of the user is required.

The cylindrical sounding tube 10 provides a single sounding chamber unlike the dual sounding chambers of the classical Stradivarius violin. Thus, unlike the classical violin, there is no requirement of synchronizing or dimensioning sounding chambers to insure proper interaction.

By this cylindrical construction, a very simple shape of sounding chamber is achieved, which is easy to manufacture. In addition, the resulting violin is relatively easy to finger. That is, in the position of the left hand fingers for the high notes on the E-string, which position is generally known as the "7th position," the violinist is able to bring his small left finger easily to the required position for the highest notes, since there is no interference with the movement of the hand and wrist by reason of the narrow diameter of the sounding tube. As a consequence, both young and older persons, who by reason of size or stiffness of joints would have extreme difficulty in fingering the ordinary classical violin, are able to achieve with ease the desired fingering. The high note fingering is achieved without twisting of arm, hand and fingers but with the configurations thereof as in the lower note positions. Moreover, this is achieved without interfering with a substantially balanced, symmetrically shaped sounding tube.

This violin has been found to be easy and inexpensive (for example, substantially less than $100.00) to manufacture by reason of its simple shape, absence of cutouts and inexpensive body material. Additionally, significantly fewer hours of effort are required of relatively less-skilled workmen to produce the violin of this invention and the lengthy aging process required for classical violins is completely eliminated. Stability of performance quality remains high in the face of changes in temperature, wetness and humidity.

From the nut 38 at the top outer end of the fingering board 22 to the bridge 20, the standard dimension of 13 inches is maintained. Thereby, the standard fingering is maintained consistent with the traditional fingering of the classical violin. No new learning of fingering is required in the handling of this violin. Rather, the disability of a strained, stretched left hand for fingering is eliminated, as well as the problem of supporting the violin with the left hand at the same time that the fingering is going on, and also the problem of holding the violin between the chin and shoulder with the chin against the chin rest. Consequently, older people who lose the flexibility of their hands can continue to play the violin notwithstanding the changes in muscle and joint coming with age. Likewise, a youngster who first approaches the violin is not presented with unnatural constraints on his hands, arms, chin and neck which lead to the discouragements of violinist's cramp and other discomforts. Though the violin is held against the body in a position similar to that of the country music fiddler, it is firmly retained so that a full range of fingering is achieved which is not otherwise available in the fiddler position.

Figure 6:
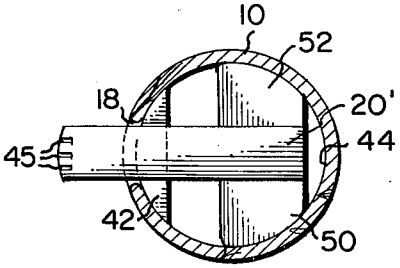
FIG. 6 is a sectional view, taken generally the same as FIG. 3, and illustrating an alternative embodiment of the violin of this invention.

In a preferred form of the invention, the bridge is constructed in a T-shape shown in the modified form of bridge 20' of FIG. 6. The cross-arms 50, 52 of the bridge 20' are curved similar to the inside curvature of the tube 10 and rest against the side surfaces rather than the bottom. Thereby, a firm and stable three-point (including the strings) support for bridge 20' is achieved.

With either construction of the bridge of this violin (FIG. 3 or FIG. 6), the vibration of the strings results in the bridge vibration, which takes place inside the tubular body, and free of the top surface thereof. Preferably, the bridge is constructed with the grain along the vertical dimension of the wooden piece, i.e., up and down as in the conventional orientation of the violin, and with the grain of the horizontal arms 50 and 52 (FIG. 6) extending from side to side. This construction produces an effective sounding body for the string vibration. The tripod retention of the bridge is very stable in contrast to the classical violin's bridge, which tends to be unstable. Alternatively, this bridge may be stamped out of plastic.

Thus, a new and improved violin construction is provided which need not be held under the chin during playing, which is easier to finger and generally constructed for the anatomy of the user so that it can be used by either the very young or the old. This violin can be constructed economically and with available manufacturing techniques. The invention is not restricted to the particular forms thereof described above, and modifications will be readily apparent to those skilled in the art.

For example, in various modifications of this invention, the tube 10 which serves as the violin body may be fabricated of suitable material other than paperboard, e.g., tubular plastic, masonite, formica, plywood or composites thereof. Other tubular shapes than the circular cylinder may be employed. Bridge 20 is positioned solely by string forces acting on tube 10 inside surface 44; thus bridge opening 18, which in the preferred embodiment is a one-inch diameter hole approximately, may be a transversely positioned slot or any other shape suitable to permit bridge 20 to pass therethrough and to permit bridge 20 to be oriented transverse to the longitudinal axis of tubing 10 when strings 36 are tensioned. A less expensive construction of this invention may use an integral member in place of a separate neck 24 and finger board 22 as has been described in the above preferred embodiment; such a combined neck and finger board would be constructed to be generally the same as with two separate parts. The open end 12 of tubing 10, which is closed when pressed against the player's shoulder, may in an alternative embodiment be sealed with a permanently positioned plug. Additionally, in another embodiment of this invention the strings 36 may be attached to the neck 24 and tensioned by means of scroll and pegs as on a conventional violin. Also, one or more sound holes of any desired shape in the top surface, e.g., a circular hole approximately one inch in diameter, may pass through the top side of tubular body 10 at a point between bridge hole 18 and the end of finger board 22; however, the hole 18 has been found suitable as a sound hole in addition to its function as a passage for the bridge 20. Other modifications of dimensions and shapes of this violin will be apparent from the above illustrative examples.

What is claimed is:

1. In a violin having a hollow resounding body, a bridge, string attaching means, a neck, a fingering board, the improvement therein of:

said resounding body including a hollow cylindrical tube of sheet material with said neck and fingering board attached to said tube longitudinally and extending from one end of said tube, and said string attaching means including means for stretching the strings between the extended end of said neck and the other end of said tube, and a bridge positioned between the ends of said tube and resting on the inside curved surface for support thereby and for supporting said strings.

2. The violin of claim 1 and further having hook means fixed on the surface of said violin body near said one end thereof for connecting said body to a band attached around the player over the left shoulder and across the chest so that said violin body is firmly pressed against and supported by the front of the player's body, whereby the violin may be played with a full range of fingering without being clamped under the player's chin.

3. The violin of claim 1 wherein said bridge is T-shaped and has curved surfaces at the ends of the cross-arm of the T-shaped for matingly engaging spaced curved portions of the interior surface.

4. The violin of claim 1 wherein said one tube end is contoured to permit access of the player's fingers during play to said finger board substantially free of interference with said tube so as to permit fingering for the highest notes with the same general hand and arm orientation as for the lower notes.

5. The violin of claim 1, wherein said tubular body has a diameter of less than 5 inches to enable bowing without indentations in the sides of said body.

6. The violin of claim 1 wherein said body is made of paperboard.

7. In a violin having a hollow resounding body, a bridge, string attaching means, a neck, a fingering board, the improvement therein of:

said resounding body including a hollow tube with said neck and fingering board attached to said tube longitudinally and extending from one end of said tube, and said string attaching means including means for stretching the strings between the extended end of said neck and the other end of said tube, and a bridge positioned between the ends of said tube for support thereby and for supporting said strings, said tubular body being open at both ends with one end being substantially closed by being pressed against player's shoulder and chest during play.

8. A violin having a hollow resounding body formed of a continuous member having opposite top and bottom surfaces, string attaching means, neck and finger board, the improvement therein comprising a bridge for supporting said strings above the top surface of said body, an opening through said top surface, said bridge being shaped to pass through said top surface opening to the interior of said hollow body and to be supported exclusively by the interior of said bottom surface of said body and to be fixed thereto by tension in the violin strings whereby string tensions are carried directly by said body member.

9. The violin of claim 8, wherein said body is substantially cylindrical, with a curved interior surface said bridge has three portions, one of said portions projecting above said violin top surface for string support, and the other two portions seating against spaced circular portions of said interior surface to distribute the stress loads of said bridge on said interior and to provide a stable bridge mounting.

* * * * *